US006201380B1

(12) United States Patent
Tsujino et al.

(10) Patent No.: US 6,201,380 B1
(45) Date of Patent: Mar. 13, 2001

(54) CONSTANT CURRENT/CONSTANT VOLTAGE GENERATION CIRCUIT WITH REDUCED NOISE UPON SWITCHING OF OPERATION MODE

(75) Inventors: Mitsunori Tsujino; Yutaka Ikeda, both of Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/488,780

(22) Filed: Jan. 21, 2000

(51) Int. Cl.[7] ..... G05F 3/20
(52) U.S. Cl. ..... 323/313
(58) Field of Search ..... 323/312, 313, 323/314

(56) References Cited

U.S. PATENT DOCUMENTS 4,725,936 * 2/1988 Nakajima et al. ..... 363/21

FOREIGN PATENT DOCUMENTS 54-109749 8/1979 (JP) .
2-67817 3/1990 (JP) .

* cited by examiner

*Primary Examiner*—Adolf Deneke Berhane
(74) *Attorney, Agent, or Firm*—McDermott, Will & Emery

(57) ABSTRACT

In a circuit producing a reference voltage that is used in an internal circuit having an operation mode switched by utilizing a MOS transistor receiving a constant voltage on its gate, a signal changing in a direction controlling a voltage change caused on a gate node is applied to the gate or a drain of the MOS transistor receiving the constant voltage on the gate when the operation mode is switched. The constant voltage can be suppressed from varying through capacitive coupling of a parasitic capacitance of the constant voltage MOS transistor when the operation mode is switched, so that the reference voltage can be stably produced.

20 Claims, 8 Drawing Sheets

CONSTANT CURRENT/CONSTANT VOLTAGE GENERATION CIRCUIT WITH REDUCED NOISE UPON SWITCHING OF OPERATION MODE

BACKGROUND OF THE INVENTION

1. Field of the Invention

The present invention relates to a constant current/constant voltage generation circuit provided in a semiconductor integrated circuit device, and more particularly, to the structure of a circuit generating a bias current for generating a constant voltage.

2. Description of the Background Art

A semiconductor integrated circuit device includes an internal voltage generation circuit for internally generating a reference voltage of a prescribed level. The internal voltage generation circuit internally generates the reference voltage, thereby enabling reduction of a pin count and generation of a reference voltage of the optimum level depending on the operating characteristics of an internal circuit.

FIG. 1 illustrates the structure of a conventional reference voltage generation circuit. Referring to FIG. 1, the conventional reference voltage generation circuit includes a constant voltage generation circuit 1 generating a constant voltage V1 not dependent on a power supply voltage Vcc, and a reference voltage production circuit 2 producing an output voltage Vout when activated in accordance with the constant voltage V1 from constant voltage generation circuit 1.

Constant voltage generation circuit 1 includes a constant current source 1*a* connected between a power supply node and a node N1 for supplying a constant current, and an N-channel MOS transistor 1*b* converting the constant current from constant current source 1*a* to the voltage V1. MOS transistor 1*b* has a gate and a drain connected to node N1 and operates in a saturation region to set the gate and drain voltages so as to receive and discharge the constant current supplied from constant current source 1*a* as a drain current. Therefore, the voltage V1 outputted to node N1 reaches a constant level not dependent on power supply voltage Vcc.

Reference voltage production circuit 2 includes an N-channel MOS transistor 2*a* connected between a node N2 and a ground node with a gate thereof connected to node N1, a P-channel MOS transistor 2*b* connected between a power supply node and a node N4 and receiving a mode switching signal ϕA at a gate thereof, a P-channel MOS transistor 2*c* connected between node N4 and node N2 with a gate thereof connected to node N2, a p-channel MOS transistor 2*d* connected between node N4 and a node N3 with a gate thereof connected to node N2 and an N-channel MOS transistor 2*e* connected between node N3 and a ground node with a gate thereof connected to node N3.

MOS transistor 2*a* forms a current mirror circuit with MOS transistor 1*b* of constant voltage generation circuit 1, while MOS transistors 2*c* and 2*d* form another current mirror circuit. MOS transistor 2*e* converts a current supplied from MOS transistor 2*d* to a voltage and produces the output voltage Vout.

Mode switching signal ϕA is a control signal for activating/inactivating the operation of the reference voltage generation circuit generating the output voltage Vout. Mode switching signal ϕA is driven to an active low level when activating the operation of generating the reference voltage Vout, and the output voltage Vout is produced in accordance with the voltage V1 on node N1. In an inactive state, mode switching signal ϕA is set high at the level of power supply voltage Vcc, MOS transistor 2*b* is turned off and current supply to MOS transistors 2*c* and 2*d* is stopped. In this state, node N2 is discharged to a ground voltage level through MOS transistor 2*a*, while node N3 is also discharged to the ground voltage level through MOS transistor 2*e*.

The constant voltage generation circuit 1 is simply required to supply the constant voltage V1 to the gate of MOS transistor 2*a*, and consumes an extremely small current. On the other hand, reference voltage production circuit 2 supplies the reference voltage Vout to a circuit such as a compare circuit or a constant current source. Therefore, the reference voltage production circuit 2 has relatively large current driving capability so as to stably drive a relatively large output load. When MOS transistors 1*b* and 2*a* are identical in size to each other, the drain voltage of MOS transistor 2*a* (i.e., the voltage of node N2) is also equal to the voltage V1. When MOS transistors 2*c* and 2*d* are equal in size to each other, the currents of nodes N2 and N3 are equal in magnitude to each other through operation of the current mirror circuit formed by MOS transistors 2*c* and 2*d*. Therefore, the level of the output voltage Vout is equal to that of voltage V1 (when MOS transistors 2*a* and 2*e* are equal in size to each other). The term "size" indicates the ratio W/L of a gate width W to a gate length L of the MOS transistors.

The reference voltage Vout can be produced in response to the operation of the circuit using the output voltage Vout by selectively activating/inactivating the reference voltage production circuit 2 through mode switching signal ϕA, thereby reducing current consumption.

FIG. 2 illustrates voltage waveforms in mode switching on respective nodes of the reference voltage generation circuit shown in FIG. 1. In a standby state, mode switching signal ϕA is set high, MOS transistor 2*b* is turned off, and the voltage on node N2 and the output voltage Vout go down to the ground voltage. Constant voltage generation circuit 1 regularly operates, and node N1 is set to voltage V1 responsive to the constant current from constant current source 1*a*.

At a time ta, mode switching signal ϕA is set to an active low level and MOS transistor 2*b* is turned on. Thus, a current is supplied to node N2 through MOS transistor 2*c*, to raise the voltage level of node N2. MOS transistor 2*a* has a parasitic capacitance Cpr provided by a parallel body of a gate capacitance formed by a gate insulative film and a fringe capacitance formed between a peripheral portion of a source/drain region thereof and a gate electrode thereof. This parasitic capacitance Cpr is connected between node N2 and node N1. When the voltage level of node N2 is raised, therefore, this voltage rise is transmitted to node N1 due to a coupling effect of parasitic capacitance Cpr, to raise the level of the constant voltage V1 on node N1. When the level of the voltage V1 on node N1 is raised, the amount of current flowing through MOS transistors 2*c* and 2*a* is increased to increase the amount of current flowing through MOS transistors 2*d* and 2*e*, thereby raising the level of the reference voltage Vout outputted from node N3. The voltage of node N2 is raised toward a prescribed level in response to the current supplied through MOS transistors 2*c* and 2*a*. Even if the voltage level of node N2 is stabilized, the voltage V1 of node N1 is at a raised level due to the coupling effect of parasitic capacitance Cpr and a relatively long time is required until MOS transistor 1*b* discharges the voltage of node N1. In a period T when the voltage level of node N1 is higher than a predetermined level, therefore, the level of the reference voltage Vout is also high and a circuit receiving the reference voltage Vout cannot stably operate during this period T. Therefore, when the mode switching signal ϕA is used for switching the standby state and an active state, for example, an activated internal circuit operates after a lapse of the time T from the time ta in a practical use. Thus, the timing for starting the operation of the internal circuit is disadvantageously delayed.

Such instability of the reference voltage in mode switching in the reference voltage generation circuit having the aforementioned mode switching function also takes place in a structure other than the current mirror type reference voltage generation circuit in general.

SUMMARY OF THE INVENTION

An object of the present invention is to provide a reference voltage generation circuit capable of stably generating a reference voltage of a prescribed level even at the time of mode switching.

Another object of the present invention is to provide a semiconductor integrated circuit device having a constant current/constant voltage generation circuit stably operating with no influence by noise even in mode switching.

Briefly stated, according to the present invention, a signal antiphase to a coupling noise caused by a parasitic capacitance is coupled to a node receiving the coupling noise in accordance with a mode switching signal upon mode switching. Alternatively, according to the present invention, charges are previously supplied to a noise source node for reducing potential change, thereby reducing coupling noise.

In mode switching, coupling noise is canceled by producing and applying the noise antiphase to the coupling noise in accordance with the mode switching signal or the coupling noise is reduced by supplying charges. Thus, a reference voltage of a prescribed level can be stably generated with no influence by noise upon mode switching.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 3:
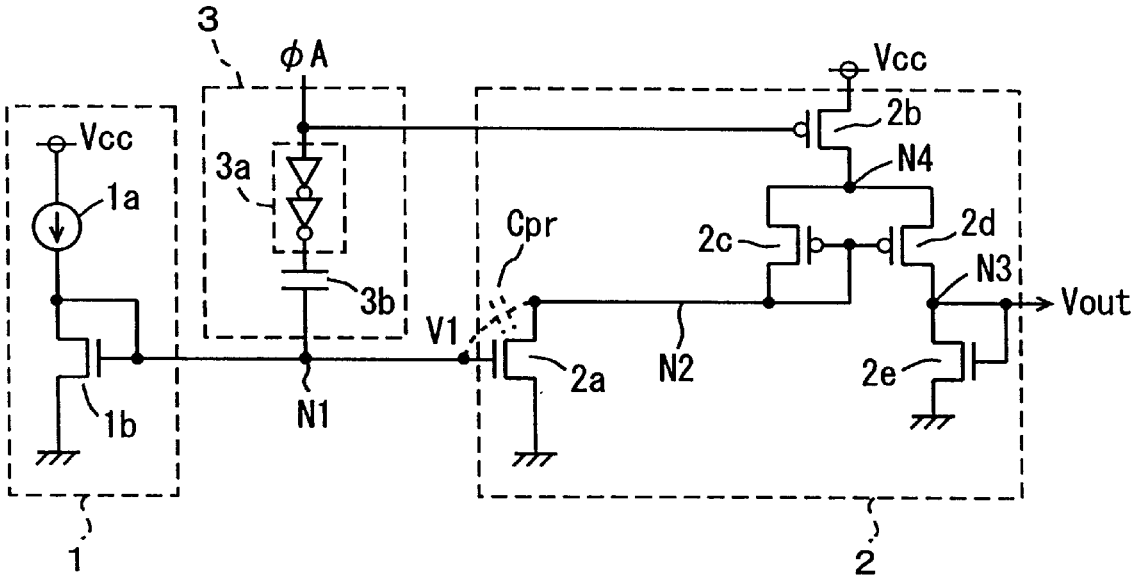
FIG. 3 illustrates the structure of a reference voltage generation circuit according to a first embodiment of the present invention.

FIG. 3 illustrates the structure of a reference voltage generation circuit according to a first embodiment of the present invention. Referring to FIG. 3, the reference voltage generation circuit includes a voltage compensation circuit 3 for compensating for a noise on a node N1 in accordance with a mode switching signal ϕA, in addition to a constant voltage generation circuit 1 and a reference voltage production circuit 2. Voltage compensation circuit 3 includes a buffer circuit 3*a* buffering the mode switching signal ϕA and a noise compensating coupling capacitor 3*b* transmitting an output signal from buffer circuit 3*a* to node N1 by capacitive coupling. Buffer circuit 3*a* is formed by cascaded inverters of two stages, for example.

Figure 1:
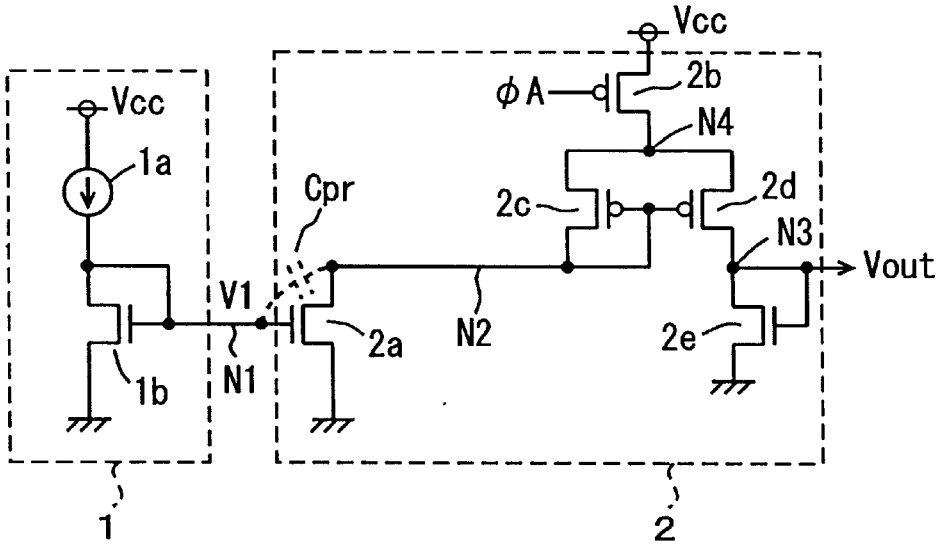
FIG. 1 PRIOR ART
FIG. 1 illustrates the structure of a conventional reference voltage generation circuit.
Figure 2:
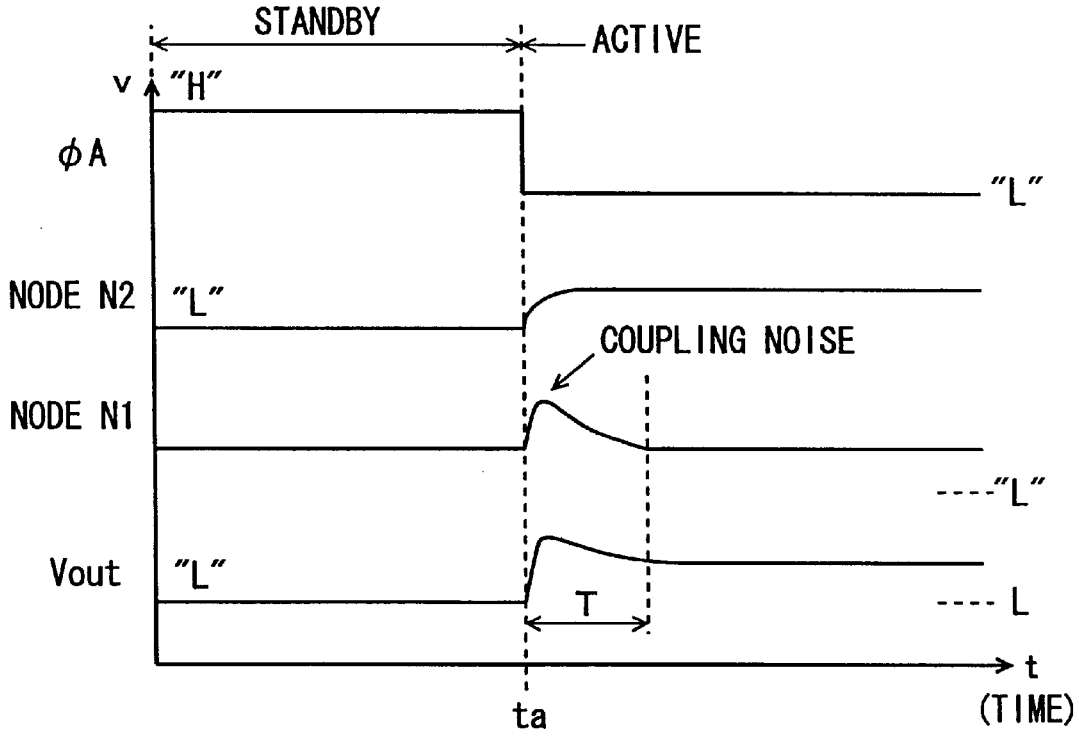
FIG. 2 PRIOR ART
FIG. 2 is a signal waveform diagram representing operations of the reference voltage generation circuit shown in FIG. 1.

Constant voltage generation circuit 1 and reference voltage production circuit 2 are identical in structure to those in the conventional reference voltage generation circuit shown in FIG. 1. Thus, corresponding parts are denoted by the same reference numerals, and description thereof is not repeated.

Figure 4:
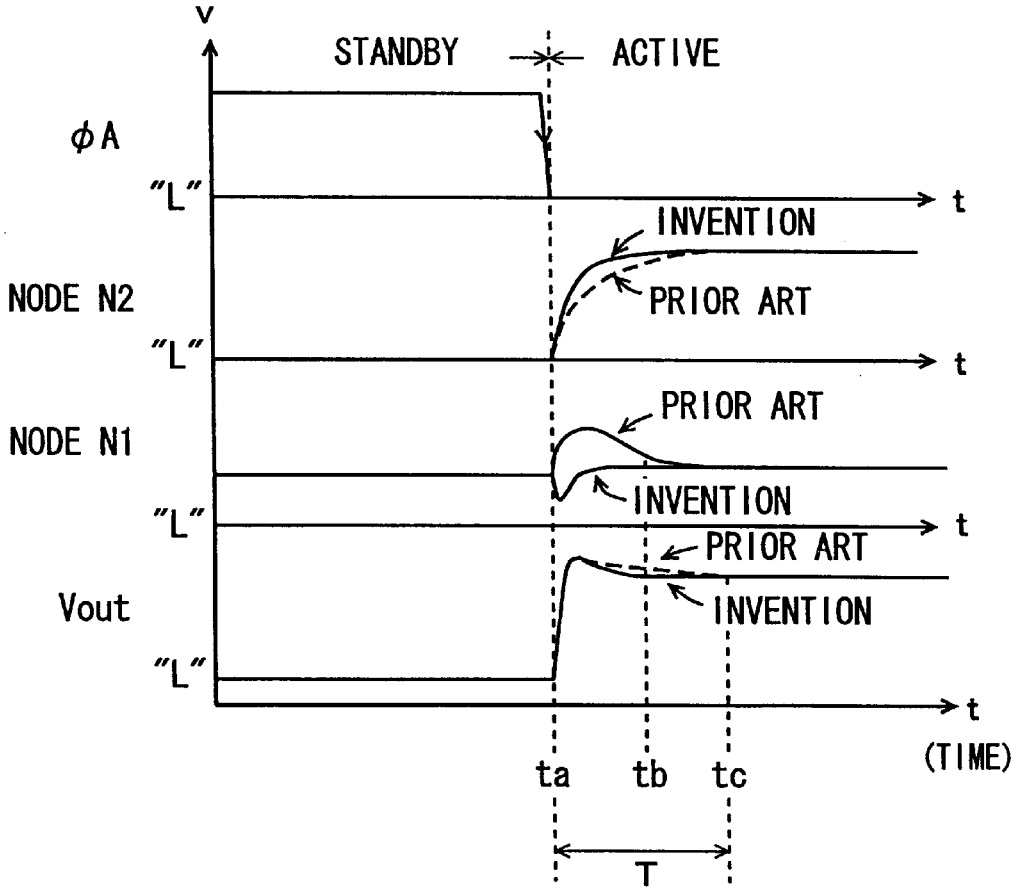
FIG. 4 is a signal waveform diagram representing operations of the reference voltage generation circuit shown in FIG. 3.

Operations of the reference voltage generation circuit shown in FIG. 3 are now described with reference to a signal waveform diagram shown in FIG. 4.

When mode switching signal ϕA is logically high, MOS transistor 2*b* is off, current supply to MOS transistors 2*c* and 2*d* is stopped and node N2 is discharged to a ground voltage level through MOS transistor 2*a*. Node N1 is supplied with constant voltage V1 from constant voltage generation circuit 1. Node N3 is held at the threshold voltage level of MOS transistor 2*a* due to a diode mode operation of MOS transistor 2*e* (when a standby time is long, node N3 is finally discharged to the ground voltage level).

At a time ta, mode switching signal ϕA falls to start an active cycle for operating an internal circuit. In response to the fall of mode switching signal ϕA, MOS transistor 2*b* is turned on and a current is supplied to node N2 through MOS transistor 2*c* to raise the voltage level of node N2. Node N3 is supplied with a current through MOS transistor 2*d*, and the output voltage Vout from node N3 rapidly rises.

The voltage increase of node N2 is transmitted to node N1 through parasitic capacitance Cpr, to raise the level of the voltage V1 on node N1. At this time, however, the voltage compensation circuit 3 transmits the mode switching signal ϕA through coupling capacitor 3*b* for transmitting a low-level signal to node N1. The voltage level of node N1 is lowered depending on the degree of coupling of coupling capacitor 3*b*. When the voltage level of node N1 is lowered, the conductance of MOS transistor 2*a* is reduced and the voltage of node N2 rises at a high speed. The voltage of node N1 is raised due to a current supplied from constant current source 1*a* of constant voltage generation circuit 1 and returns to a prescribed level. When the voltage level of node N1 is raised due to capacitive coupling similarly to the prior art, rise of the voltage level at node N2 is slowed down due to a large amount of discharge current for node N2. On the other hand, rise of the voltage level of node N1 is suppressed so that the amount of discharge current through MOS transistor 2*a* is not increased, and the voltage of node N2 rises at a high speed in response to the current supplied from MOS transistor 2*c*. This is because the voltage on node N2 is raised at a high speed when the voltage on node N1 is not raised by noise, provided that the current supplied from MOS transistor 2*c* is not changed.

When the voltage level of node N1 is stabilized at a time tb, therefore, the output voltage Vout from node N3 is also stabilized to a prescribed level. The reference voltage Vout from node N3 exceeds the prescribed level in mode switching from the following reason: MOS transistor 2*e* is off when the voltage level of node N1 is lowered and a current is supplied from MOS transistor 2*d* after the voltage level of node N3 is raised in response to the current supplied from MOS transistor 2*e* to increase the conductance of MOS transistor 2*e*, the reference voltage Vout from node N3 is stabilized to the prescribed level when the current supplied from MOS transistor 2*d* balances with the discharge current through MOS transistor 2*e* (when an active cycle is started, the amount of current supplied from MOS transistor 2*d* is larger than the amount of discharge current by MOS transistor 2*e*).

In the prior art, the voltage level of node N2 is slowly raised due to floating-up of the potential on node N1 and the amount of current supplied from MOS transistor 2*c* is reduced in accordance with the increase of the voltage level on node N2 and hence the reference voltage Vout from node N3 is lowered at a low speed. In the prior art, therefore, the reference voltage Vout is stabilized to the prescribed level at a time tc.

Thus, the reference voltage Vout can be stabilized at a faster timing by providing the voltage compensation circuit 3 and applying a signal to node N1 in a direction canceling the coupling noise, thereby stably operating the internal circuit at a faster timing.

Voltage compensation circuit 3 includes the coupling capacitor 3*b* and hence the voltage level of node N1 is raised due to rise of mode switching signal ϕA in transition from an active cycle to a standby cycle. At this time, the voltage of node N2 may be discharged at a high speed through MOS transistor 2*a*, to reach the ground voltage level. When the voltage level of node N2 is lowered, MOS transistor 2*b* is off and current supply from a power supply node is stopped. Similarly, the output voltage Vout from node N3 is also discharged at a high speed through MOS transistor 2*e*, and lowered to the ground voltage level or a threshold voltage level. Thus, the reference voltage production circuit 2 can be set inactive at quick timing in transition to the standby cycle.

In the structure shown in FIG. 3, the voltage compensation circuit 3 buffers the mode switching signal ϕA for transmission to node N1 through coupling capacitor 3*b*. At the time ta, therefore, the voltage level of node N1 is lowered after noise temporarily is generated on the node N1 in mode switching. An anti-phase signal may be transmitted to node N1 at timing faster than that of voltage increase of node N2. The voltage level of node N2 is raised while the voltage level of node N1 is lowered. This is implemented by supplying the mode switching signal ϕA to the gate of MOS transistor 2*b* through a delay buffer circuit.

According to the first embodiment of the present invention, as hereinabove described, noise can be readily canceled by applying a signal antiphase to the noise to a node causing the noise in mode switching, thereby stably producing a reference voltage.

The capacitance value of coupling capacitor 3*b* for noise compensation is appropriately set depending on the capacitance value of parasitic capacitance Cpr. The coupling capacitor 3*b* transmits a signal of an amplitude Vcc to node N1, while the parasitic capacitance Cpr transmits signal change on node N2 to node N1. Therefore, the coupling capacitor 3*b* may be formed by a MOS capacitor employing a MOS transistor similar in dimension to MOS transistor 2*a*, or may be formed with a MOS transistor smaller in dimension than MOS transistor 2*a* (the amount of charges injected by the parasitic capacitance Cpr into node N1 is merely required to be equal to the amount of charges discharged by coupling capacitor 3*b*).

Second Embodiment

Figure 5:
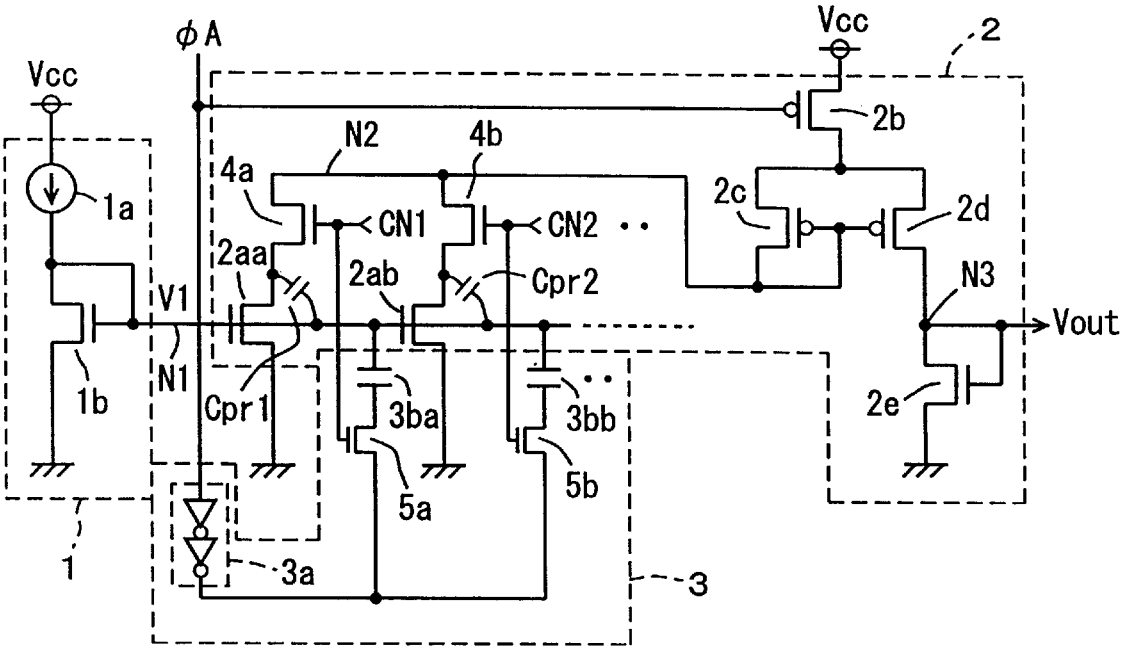
FIG. 5 illustrates the structure of a reference voltage generation circuit according to a second embodiment of the present invention.

FIG. 5 illustrates the structure of a reference voltage generation circuit according to a second embodiment of the present invention. In the structure shown in FIG. 5, the relation between a reference voltage Vout and a constant voltage V1 can be programmed (tuned). A reference voltage production circuit 2 includes MOS transistors 4*a* and 2*aa* serially connected between a node N2 and a ground node and MOS transistors 4*b* and 2*ab* serially connected between node N2 and ground node in place of MOS transistor 2*a*. MOS transistors 2*aa* and 2*ab*, gates of which are connected in common to node N1, form a current mirror circuit with a MOS transistor 1*b* of a constant voltage generation circuit 1. Gates of MOS transistors 4*a* and 4*b* are supplied with count values CN1 and CN2. A tuning counter with count values thereof programmable outputs the count values CN1 and CN2, in order to set the level of the reference voltage Vout in a trimming step.

A voltage compensation circuit 3 includes coupling capacitors 3*ba* and 3*bb* provided in correspondence to MOS transistors 2*aa* and 2*ab*, an N-channel MOS transistor 5*a* transmitting a mode switching signal ϕA from a buffer circuit 3*a* to coupling capacitor 3*ba* in accordance with count value CN1, and an N-channel MOS transistor 5*b* transmitting the mode switching signal ϕA from buffer circuit 3*a* to coupling capacitor 3*bb* in accordance with count value CN2.

When count values CN1 and CN2 are high ("1"), MOS transistors 4*a* and 4*b* are turned on and MOS transistors 2*aa* and 2*ab* are coupled to node N2. Voltage change on node N2 is transmitted to drains of MOS transistors 2*aa* and 2*ab*, and hence capacitive coupling noise is generated on node N1 through source/drain-to-gate parasitic capacitances Cpr1 and Cpr2 of MOS transistors 2*aa* and 2*ab*. When only one of count values CN1 and CN2 is high, parasitic capacitance Cpr (Cpr1 or Cpr2) of either MOS transistor (2*aa* or 2*ab*) transmits capacitive coupling noise to node N1. Count values CN1 and CN2 determines the parasitic capacitance(s)

transmitting noise by capacitive coupling to node N1. Therefore, capacitive coupling noise from node N2 onto node N1 can be reliably canceled by selectively driving the coupling capacitors 3*ba* and 3*bb* for noise compensation through MOS transistors 5*a* and 5*b* in accordance with count values CN1 and CN2.

When count value CN1 is logically high, MOS transistor 2*aa* is coupled to node N2 and capacitive coupling noise is transmitted to node N1 by parasitic capacitance Cpr1 of MOS transistor 2*aa*. At this time, antiphase noise can be supplied to node N1 by supplying the mode switching signal ϕA from buffer circuit 3*a* to coupling capacitor 3*ba* through MOS transistor 5*a*, thereby canceling noise by parasitic capacitance Cpr1. When count value CN2 is logically high, capacitive coupling noise by parasitic capacitance Cpr2 is similarly canceled by coupling capacitor 3*bb*. Also in the programmable reference voltage generation circuit, therefore, noise in mode switching can be correctly reduced by providing the coupling capacitors 3*ba* and 3*bb* having capacitance values corresponding to the degrees of coupling of parasitic capacitances Cpr1 and Cpr2 respectively and by selectively driving the coupling capacitors by corresponding count values CN1 and CN2.

Count values CN1 and CN2 are set as follows: When both count values CN1 and CN2 are logically high, a mirror current twice a current flowing through constant current source 1*a* flows through node N2 if MOS transistors 2*aa* and 2*ab* are identical in size to MOS transistor 1*b*. MOS transistor 2*c* supplies the mirror current flowing through node N2. Therefore, a current flowing through MOS transistor 2*d* is larger than that flowing when the single MOS transistor 2*a* is used, and the level of the reference voltage Vout generated by MOS transistor 2*e* is responsively raised. MOS transistor 2*e* normally operates in a saturation region and hence the level of the output reference voltage Vout is raised by about $\sqrt{2}$ times if the current supplied from MOS transistor 2*d* is doubled. When the level of the constant voltage V1 from constant voltage generation circuit 1 is lower than a designed value, the level of the reference voltage Vout is raised and set to the optimum value by programming the count values CN1 and CN2.

Figure 6A:
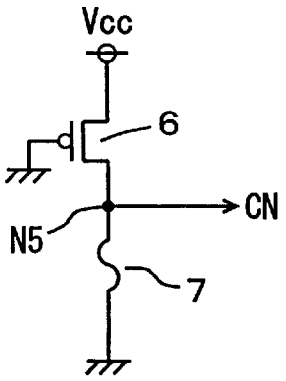
FIGS. 6A and 6B each illustrate a structure of a tuning count value generation part shown in FIG. 5.

FIG. 6A schematically illustrates the structure of count circuit of one bit of the tuning counter generating the count values CN1 and CN2 shown in FIG. 5. Referring to FIG. 6A, the tuning count circuit includes a high-resistance P-channel MOS transistor 6 connected between a power supply node and an output node N5 and a fusible link element 7 connected between node N5 and ground node. The output node N5 outputs a count value CN. MOS transistor 6 has a gate connected to ground node and is regularly conductive, and has its channel resistance sufficiently high for serving as a resistive element of high resistance. When the link element 7 is blown, node N5 is pulled up by MOS transistor 6 and the count value CN goes up. When the link element 7 is held conductive, the node N5 is discharged to ground node through link element 7 and the count value CN goes down. The count value CN can be programmed by blow/non-blow of link element 7.

Figure 6B:
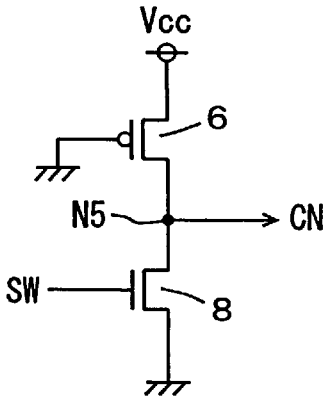

FIG. 6B schematically illustrates another structure of count circuit of one bit of the tuning counter. The tuning count circuit shown in FIG. 6B includes a high-resistance P-channel MOS transistor 6 connected between a power supply node and an output node N5, and an N-channel MOS transistor 8 connected between node N5 and ground node and receiving a switching signal SW in its gate. Switching signal SW is generated from a program circuit such as that shown in FIG. 6A. MOS transistor 6 is regularly on with its gate coupled to the ground node, and serves as a high-resistance element due to high channel resistance thereof, and supplies only a small current. When switching signal SW is logically low, a count value CN from node N5 goes up. When the switching signal SW is logically high, MOS transistor 8 is turned on and the count value CN from node N5 goes down.

The level of the reference voltage Vout generated from the reference voltage generation circuit can be trimmed by utilizing the count circuit shown in FIG. 6A or 6B for producing the reference voltage Vout of a desired level and optimally operating an internal circuit even if manufacturing parameters are varied.

When a fusible link element is employed in place of MOS transistors 4*a* and 4*b* for tuning, a link element may be employed also in voltage compensation circuit 3 in place of MOS transistors 5*a* and 5*b*. Blow/nonblow of a corresponding link element is executed in voltage compensation circuit 3 depending on blow/non-blow of the link elements in reference voltage production circuit 2. Thus, the capacitance values of the coupling capacitors for noise compensation can be set depending on the magnitude of the parasitic capacitances at node N1.

According to the second embodiment of the present invention, as hereinabove described, coupling capacitors are provided corresponding to tuning MOS transistors and a mode switching signal is selectively supplied to the coupling capacitors in accordance with programmed states for conduction/non-conduction of corresponding tuning MOS transistors and the current driving capability of transistors of a constant voltage input part of the reference voltage generation circuit is programmable. Thus, even when the degree of capacitive coupling is changed depending on the programmed current value, a degree of capacitive coupling corresponding to the changed coupling capacitance can be correctly implemented for correctly suppressing occurrence of noise in mode switching.

Third Embodiment

Figure 7:
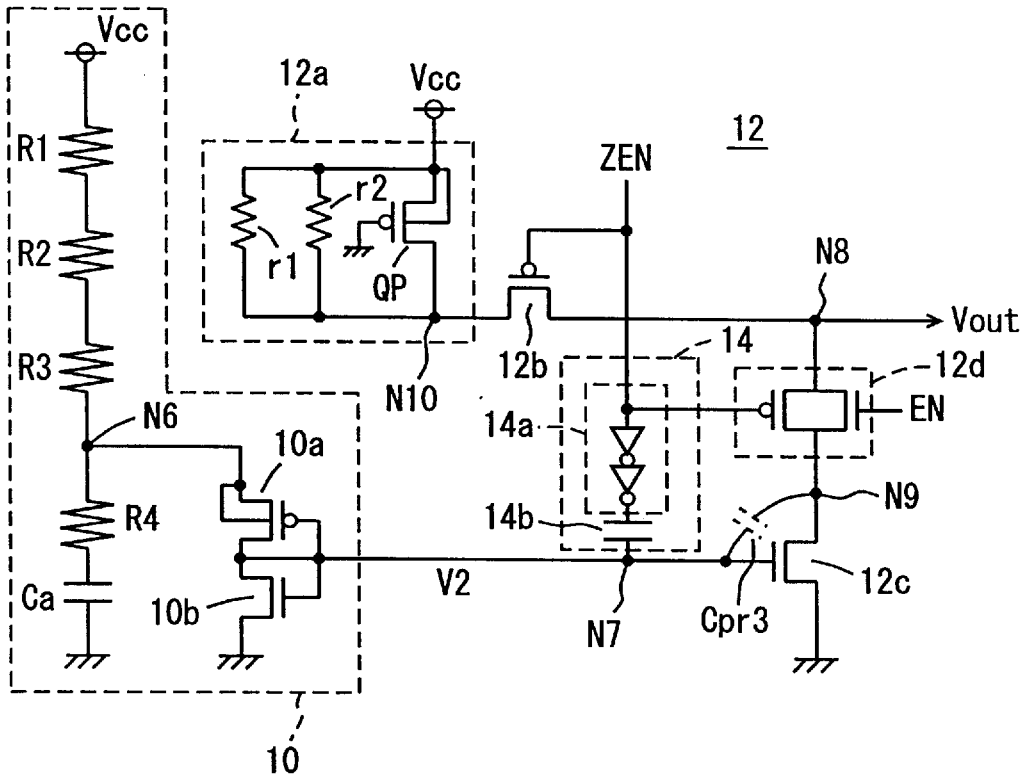
FIG. 7 illustrates the structure of a reference voltage generation circuit according to a third embodiment of the present invention.

FIG. 7 illustrates the structure of a reference voltage generation circuit according to a third embodiment of the present invention. Referring to FIG. 7, the reference voltage generation circuit includes a constant voltage generation circuit 10 generating a constant voltage V2 on a node N7 and a reference voltage production circuit 12 selectively activated in response to operation mode instruction signals ZEN and EN for producing a reference voltage Vout in accordance with the voltage V2 on node N7.

Constant voltage generation circuit 10 includes resistive elements R1 to R3 serially connected between a power supply node and a node N6, a resistive element R4 and a capacitive element Ca serially connected between node N6 and a ground node, a P-channel MOS transistor 10*a* connected between node N6 and the output node N7 with its gate connected to node N7, and an N-channel MOS transistor 10*b* connected between node N7 and ground node with its gate connected to node N7. MOS transistors 10*a* and 10*b* operate in a resistance mode or a diode mode, and produce the voltage V2 in accordance with the voltage of node N6. Resistive element R4 and capacitive element Ca serve as a stabilizing circuit (integrating circuit) stabilizing the voltage of node N6 and suppressing occurrence of noise.

When the channel resistance values of MOS transistors 10*a* and 10*b* are the same order as the combined resistance value of resistive elements R1 to R3, the constant voltage generation circuit 10 produces a voltage obtained by dividing the voltage on node N6 in accordance with the ratio of the channel resistances of MOS transistors 10*a* and 10*b*. When the channel resistance values of MOS transistors 10*a* and 10*b* are sufficiently smaller than the combined resistance value of resistive elements R1 to R3, MOS transistors 10*a* and 10*b* operate in the diode mode to cause voltage drops of the absolute values of threshold voltages. In this case, therefore, the voltage V2 on node N7 reaches the level of the threshold voltage Vthn of MOS transistor 10*b*. Reference voltage production circuit 12 produces the reference voltage Vout with the voltage V2 on node N7 received as a bias voltage.

Reference voltage production circuit 12 includes a resistive circuit 12*a* connected between a power supply node and a node N10, a P-channel MOS transistor 12*b* rendered conductive for connecting the node N10 to a node N8 when the operation mode instruction signal ZEN is activated, a CMOS transmission gate 12*b* rendered conductive for coupling the node N8 to a node N9 when the operation mode instruction signals ZEN and EN are activated, and an N-channel MOS transistor 12*c* connected between the node N9 and a ground node and receiving the voltage V2 on node N7 on its gate.

Resistive circuit 12*a* includes resistive elements r1 and r2 connected in parallel between a power supply node and node NlO and a P-channel MOS transistor QP connected between the power supply node and node N10 in parallel with resistive elements r1 and r2. MOS transistor QP has a gate coupled to a ground node, and operates as a resistive element. Therefore, the resistive circuit 12*a* causes a voltage drop determined by its combined resistance value R(12*a*) and a current I(12*c*) flowing through MOS transistor 12*c*. The reference voltage Vout is supplied to gate of MOS transistor, as described later. Assuming that I(12*c*) represents a current flowing through MOS transistor 12*c*, the reference voltage Vout is expressed as follows:

$$Vout=Vcc-I(12c)\cdot R(12a)$$

MOS transistor 12*c* operates as a constant current source since the voltage V2 on its gate is constant, and the current I(12*c*) reaches a constant value. If a power supply voltage Vcc is constant, the voltage Vout from node N8 also reaches a constant level. The resistive elements r1 and r2, which are trimmable resistive elements, are provided for adjusting the level of the reference voltage Vout.

Figure 8:
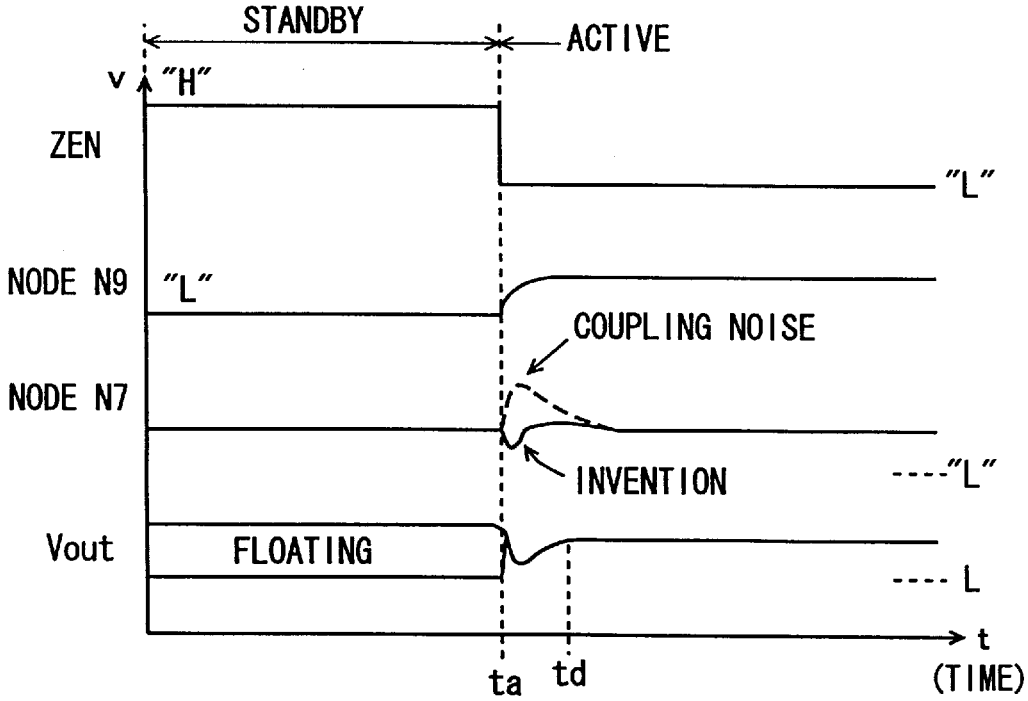
FIG. 8 is a signal waveform diagram representing operations of the reference voltage generation circuit shown in FIG. 7.

The reference voltage generation circuit further includes a voltage compensation circuit 14 for compensating for capacitive coupling noise on node N7. Voltage compensation circuit 14 includes a buffer circuit 14*a* receiving the operation mode instruction signal ZEN and a coupling capacitor 14*b* transmitting an output signal of buffer circuit 14*a* to node N7 by capacitive coupling. A parasitic capacitance Cpr3 provided by the combination of a fringe capacitance and a gate capacitance of MOS transistor 12*c* is present between node N9 and node N7. Operations of the reference voltage generation circuit shown in FIG. 7 in operation mode switching are now described with reference to a signal waveform diagram shown in FIG. 8.

When the reference voltage generation circuit is inactive, the operation mode instruction signal ZEN is logically high, the operation mode instruction signal EN is logically low, P-channel MOS transistor 12*b* is off, and CMOS transmission gate 12*d* is non-conductive. In this state, node N8 is in an electrically floating state and the level of the reference voltage Vout is lowered due to a leakage current. Node N9 is discharged to the ground voltage level through MOS transistor 12*c*. Node N7 is supplied with the constant voltage V2 from constant voltage generation circuit 10.

When a circuit using the reference voltage Vout from the reference voltage generation circuit is activated, the operation mode instruction signals ZEN and EN are driven to logically low and high levels, respectively. In response, MOS transistor 12*b* is turned on, CMOS transmission gate 12*d* is rendered conductive, and node N8 is coupled to node N9. Therefore, node N9 is supplied with a current through resistive circuit 12*a* (if the reference voltage Vout is higher than the ground voltage, charges stored in node N8 are supplied to node N9). The voltage level on node N9 is raised at high speed in response, and the voltage level on node N7 is raised due to capacitive coupling of parasitic capacitance Cpr3. When the voltage level on node N7 is raised, the conductance of MOS transistor 12*c* is increased to extract a larger current from resistive circuit 12*a*, and the voltage level on node N8 is lowered below a prescribed level (since a voltage drop in the resistive circuit 12*a* is increased). When the operation mode instruction signal ZEN is driven to a low-level active state, increase of the voltage V2 on node N7 is suppressed due to transmission of a low-level voltage to node N7 by voltage compensation circuit 14 through coupling capacitor 14*b* and the voltage V2 on node N7 is lowered below the prescribed level (when the degree of coupling of coupling capacitor 14*b* is larger than the degree of coupling of parasitic capacitance Cpr3).

Therefore, a current flowing from node N9 through MOS transistor 12*c* is reduced and the level of the voltage Vout on node N8 is raised. The voltage V2 on the node N7 returns to the prescribed level by MOS transistors 10*a* and 10*b*. When the voltage V2 on node N7 returns to the prescribed level, MOS transistor 12*c* operates as a constant current source and the voltage Vout on node N8 is stabilized 12*c* at a high speed to a level determined by the resistance value of resistive circuit 12*a* and the constant current flowing through MOS transistor.

If coupling noise is generated on node N7 due to the current flowing from resistive circuit 12*a* into node N9 under the condition that the reference voltage Vout is discharged to the ground voltage level in a standby state, the reference voltage Vout is raised at a low speed (due to a time required for the voltage V2 to cancel the coupling noise and reach the prescribed level). However, the reference voltage Vout returns from the ground voltage level to the prescribed level at a high speed by canceling the coupling noise through voltage compensation circuit 14 (since return to a predetermined voltage level by MOS transistors 10*a* and 10*b* is performed at a high speed if fluctuation of the voltage V2 is small).

Therefore, fluctuation of the current driven by the constant current source transistor 12*c* can be suppressed for stably driving the reference voltage Vout to the prescribed level at a high speed when the reference voltage generation circuit makes transition from the standby state to the active state regardless of the level of the reference voltage Vout in the standby state.

When the operation mode instruction signal ZEN returns to a high level, the voltage on node N7 is raised by coupling capacitor 14*b*. At this time, MOS transistor 12*b* and CMOS transmission gate 12*d* are rendered non-conductive and node N8 enters an electrically floating state, to exert no adverse influence on the reference voltage Vout. MOS transistor 10*b* discharges the increased voltage V2 on node N7, and MOS transistors 10*a* and 10*b* stably hold the voltage V2 on node N7 at the prescribed level.

Also when noise is generated on the gate of the constant current source transistor in operation mode switching in the reference voltage generation circuit shown in FIG. 7 employing a resistance division circuit, the reference voltage Vout can be driven to the constant level at a high speed while canceling influence by coupling noise generated on the gate of the constant current source transistor in the operation mode switching by applying an antiphase signal to the gate of the constant current source transistor.

Fourth Embodiment

Figure 9:
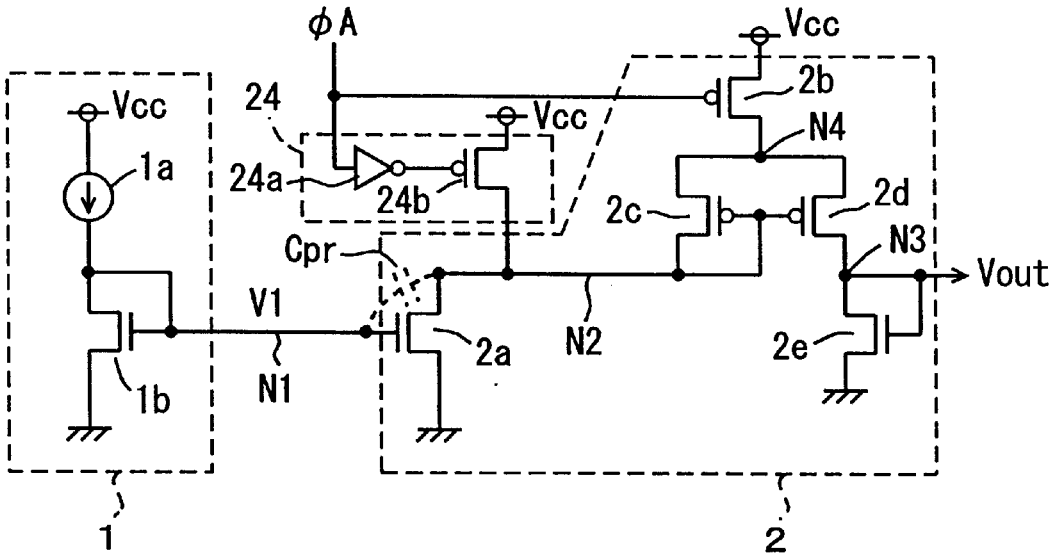
FIG. 9 illustrates the structure of a reference voltage generation circuit according to a fourth embodiment of the present invention.

FIG. 9 illustrates the structure of a reference voltage generation circuit according to a fourth embodiment of the present invention. The reference voltage generation circuit shown in FIG. 9 includes a current supply circuit 24 transmitting a small current (e.g., several 10 $\mu$A) to a node N2 when a mode switching signal ϕA is in a high-level active state, in addition to a constant voltage generation circuit 1 and a reference voltage production circuit 2. Constant voltage generation circuit 1 and reference voltage production circuit 2 are identical in structure to those of the reference voltage generation circuit shown in FIG. 3. Therefore, corresponding parts are denoted by the same reference numerals, and a description thereof is not repeated.

Current supply circuit 24 includes an inverter 24*a* receiving the mode switching signal ϕA, and a P-channel MOS transistor 24*b* rendered conductive, when an output signal from the inverter 24*a* is low, for supplying a small current from a power supply node to node N2. MOS transistor 24*b* is sufficiently reduced in size (W/L), and supplies a small current of about several 10 $\mu$A, for example, to node N2 when rendered conductive. Thus, increase of current consumption in a standby state and others is suppressed.

Figure 10:
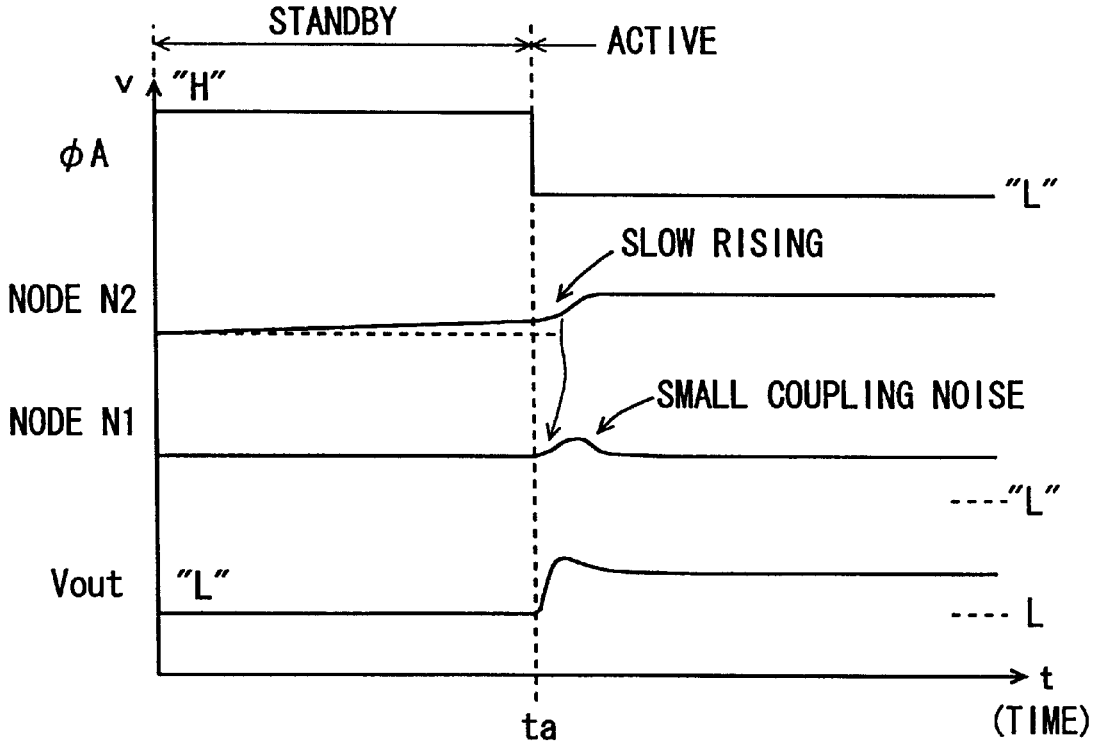
FIG. 10 is a signal waveform diagram representing operations of the reference voltage generation circuit shown in FIG. 9.

Operations of the reference voltage generation circuit shown in FIG. 9 are now described with reference to a signal waveform diagram shown in FIG. 10.

In the standby state, the mode switching signal ϕA is at a high level, the reference voltage generation circuit stops generating a reference voltage Vout, which in turn is at a low level Node N1 is maintained at a prescribed voltage level in accordance with a constant voltage V1 from constant voltage generation circuit 1. In this standby state, the mode switching signal ϕA is high in level while the output signal from inverter 24*a* is low in level and MOS transistor 24*b* is on in current supply circuit 24. Node N2 is supplied with the small current through MOS transistor 24*b* of current supply circuit 24, and the voltage level of node N2 is raised.

When the mode switching signal ϕA goes low, MOS transistor 24*b* is turned off and MOS transistor 2*b* is turned on. Therefore, node N2 is supplied with a current through MOS transistor 2*b* and MOS transistor 2*c*. The voltage level of node N2 is raised in the standby state due to the current supplied from MOS transistor 24*b*. When the mode switching signal ϕA goes low, MOS transistor 2*c* having a small gate-to-source voltage supplies a current to node N2 with relatively small current driving power. Therefore, the voltage of node N2 is raised at a low speed and coupling noise on node N1 through parasitic capacitance Cpr is responsively small. Constant voltage generation circuit 1 absorbs the small noise on node N1 at a relatively high speed. Thus, noise on the constant voltage V1 from constant voltage generation circuit 1 can be sufficiently suppressed and the reference voltage Vout can be responsively stabilized at a high speed also in mode switching. At this time, rise of the output voltage Vout is slightly slowed down in response to rise of the voltage on node N2, while the voltage Vout can be stabilized at a sufficiently higher level as compared to the prior art.

If the standby state continues over a sufficiently long time in a sleep mode, for example, the voltage on the node N2 may conceivably be raised to a considerably high level. However, MOS transistor 2*a* forming a current mirror circuit with MOS transistor 1*b* lowers the voltage of node N2 and maintains the node N2 at a substantially constant voltage level. If the current supplied by MOS transistor 24*b* is substantially identical to that supplied by constant current source 1*a*, the voltage on node N2 can be held at the constant voltage V1 at the maximum.

According to the fourth embodiment of the present invention, as hereinabove described, a node causing noise is supplied with a current in mode switching and hence voltage change on this node can be slowed down and coupling noise can be responsively reduced in mode switching for stably producing a constant voltage and an internal reference voltage.

Fifth Embodiment

Figure 11:
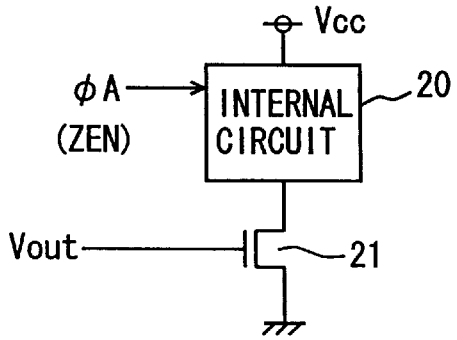
FIG. 11 illustrates an exemplary structure of a circuit using a reference voltage.

FIG. 11 illustrates an exemplary structure of a circuit utilizing a reference voltage Vout. Referring to FIG. 11, the reference voltage Vout is supplied to a gate of a current source transistor 21. Current source transistor 21 determined an operating current of an internal circuit 20. Internal circuit 20 is activated/inactivated in accordance with a mode switching signal ϕA (or ZEN) and executes a prescribed operation. When the mode switching signal ϕA instructs a standby state, internal circuit 20 is in a non-operating state, the reference voltage Vout is at a low level, and current source transistor 21 stops discharging a constant current. When the mode switching signal ϕA goes high, current source transistor 21 discharges a constant current according to the reference voltage Vout.

Figure 12:
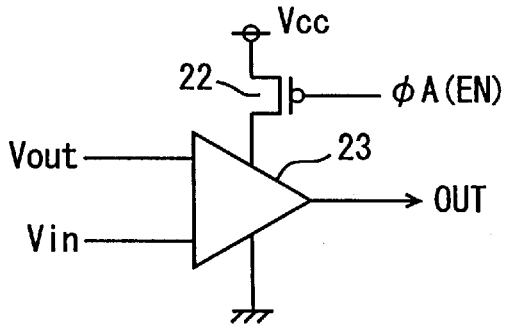
FIG. 12 illustrates another exemplary structure of the circuit using the reference voltage.

FIG. 12 illustrates another exemplary structure of an internal structure utilizing the reference voltage Vout. The structure shown in FIG. 12 includes a comparator 23 comparing the reference voltage Vout with an internal voltage Vin, and a power supply transistor 22 rendered conductive, when a mode switching signal ϕA is activated, for supplying an operating current from a power supply node to comparator 23. Power supply transistor 22 and comparator 23 form a comparison circuit, for producing an output voltage OUT in response to the result of comparison of the reference voltage Vout and internal voltage Vin when activated.

In this comparison circuit, power supply transistor 22 is nonconductive when the mode switching signal ϕA is at a high level, and comparator 23 stops comparing operation. At this time, generation of the reference voltage Vout is also stopped. As shown in FIGS. 11 and 12, therefore, current consumption in a standby state can be reduced by generating the reference voltage Vout only in operation of the internal circuit, thereby implementing a semiconductor integrated circuit device having a low standby current.

Figure 13:
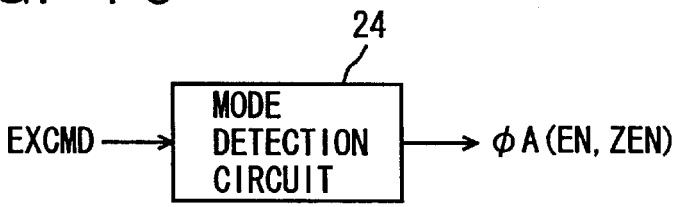
FIG. 13 schematically illustrates the structure of a mode switching signal (operation mode instruction signal) generation part.

FIG. 13 schematically illustrates the structure of a part generating the mode switching signal ϕA or operation mode instruction signals EN and ZEN. Referring to FIG. 13, a mode detection circuit 24 produces the mode switching signal ϕA (or operation mode instruction signals EN and ZEN) in accordance with an external command EXCMD. When external command EXCMD instructs activation at an internal circuit, mode detection circuit 24 drives the mode switching signal ϕA to an active low level. The externally supplied command EXCMD is an array activation command (active command) for driving a memory cell array to an active state if this semiconductor integrated circuit device is a dynamic random access memory, for example. At this time, mode switching signal ϕA is driven to an active low level instructing an active cycle and operation mode instruction signal EN is driven to a high level instructing the active cycle. When external command EXCMD is a precharge command instructing completion of array activation, mode detection circuit 24 drives the mode switching signal ϕA to a high level. When external command EXCMD instructs a sleep mode stopping the operation of the internal circuit in place of the precharge command, for example, mode detection circuit 24 may set the mode switching signal ϕA in a high-level state indicating the standby state.

In place of external command EXCMD, a circuit detecting the standby state in an internal access detection circuit may produce the mode switching signal ϕA if a standby state with no operation continues over a long period as in a portable telephone. Mode detection circuit 24 is merely required to detect a signal designating a standby/active cycle of a circuit utilizing the internal reference voltage Vout.

Sixth Embodiment

Figure 14:
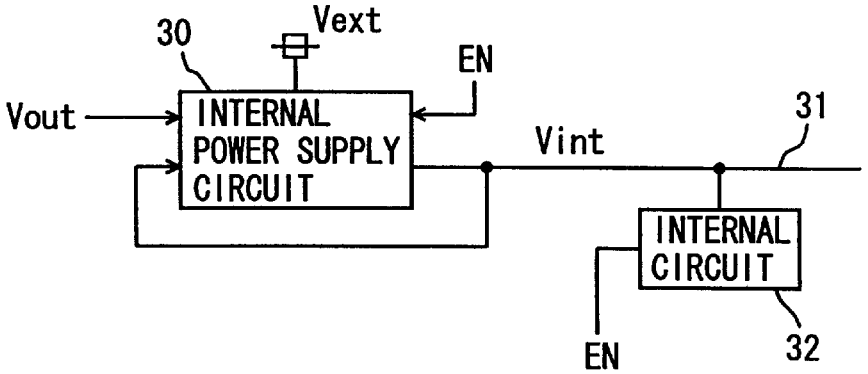
FIG. 14 schematically illustrates the structure of an internal voltage generation circuit according to the present invention.

FIG. 14 schematically illustrates the structure of a main part of a semiconductor integrated circuit device according to a sixth embodiment of the present invention. Referring to FIG. 14, the semiconductor integrated circuit device includes an internal power supply circuit 30 comparing an internal power supply voltage Vint on an internal power supply line 31 with a reference voltage Vout for supplying a current from an external power supply voltage Vext to internal power supply line 31 in accordance with the result of comparison and holding the internal power supply voltage Vint at a constant level, and an internal circuit 32 using the internal power supply voltage Vint on internal power supply line 31 as an operating power supply voltage to perform a prescribed operation.

When operation mode instruction signal EN is activated, internal power supply circuit 30 compares the internal power supply voltage Vint with the reference voltage Vout and supplies a current from a node supplying the external power supply voltage Vext to internal power supply line 31 in accordance with the result of comparison. Therefore, internal power supply voltage Vint is maintained at a level determined by the reference voltage Vout. When operation mode instruction signal EN is activated, further, internal circuit 32 executes a prescribed operation. Therefore, internal power supply circuit 30 is activated in a period when internal circuit 32 consumes the internal power supply voltage Vint, to execute the operation of producing the internal power supply voltage Vint.

Figure 15:
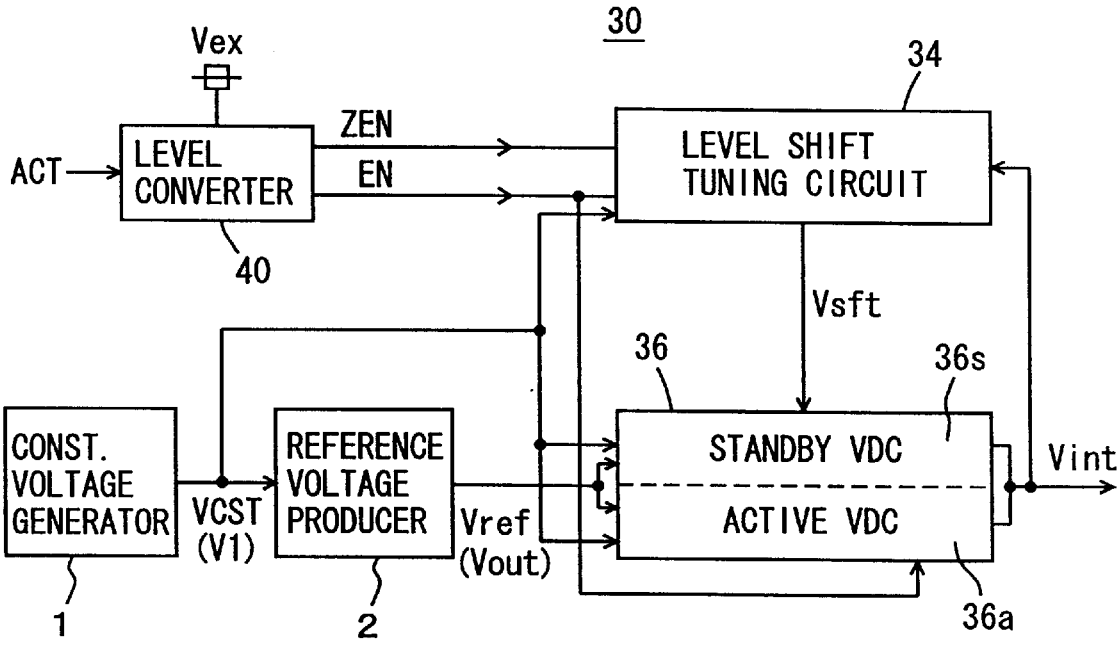
FIG. 15 schematically illustrates the structure of an internal power supply circuit shown in FIG. 14.

FIG. 15 schematically illustrates the structure of internal power supply circuit 30 shown in FIG. 14. Internal power supply circuit 30 includes a level shift tuning circuit 34 receiving a constant voltage from a constant voltage generator 1 and activation signals ZEN and EN from a level converter 40 to shift the level of internal power supply voltage Vint in response to an operation mode for producing a shift voltage Vsft, and an internal voltage down converter 36 producing the internal power supply voltage Vint in accordance with a reference voltage Vref (Vout) from a reference voltage production circuit (producer) 2 and the shift voltage Vsft from level shift tuning circuit 34.

Level converter 40 converts an internal circuit activation signal ACT to a signal of an external power supply voltage Vex level. Constant voltage generation circuit 1 and reference voltage production circuit 2 are identical in structure to those described with reference to the first to third embodiments, and the reference voltage Vref (Vout) is set to a level corresponding to the level of a constant voltage VCST (V1).

Level shift tuning circuit 34 shifts the internal power supply voltage Vint and produces the shift voltage Vsft when operation mode instruction signals En and ZEN are active, and outputs the internal power supply voltage Vint as the shift voltage Vsft when operation mode instruction signals ZEN and EN designate a standby state. Internal voltage down converter circuit 36 can make the comparison in the most sensitive region by the shift operation of level shift tuning circuit 34, for compensating for change of internal power supply voltage Vint at a high speed in an active cycle causing a large current consumption.

The internal voltage down converter 36 includes a standby voltage down converter (VDC) 36*s* operating in the standby state for maintaining the level of internal power supply voltage Vint and an active VDC 36*a* operating in the active cycle for maintaining the internal power supply voltage Vint at a prescribed level. Active VDC 36*a* operates, when operation mode instruction signal EN is activated and a relatively large current is consumed, for compensating for fluctuation of internal power supply voltage Vint consumed by an internal circuit. Standby VDC 36*s* consumes a sufficiently small current for simply compensating for reduction of internal power supply voltage Vint resulting from a leakage current in the standby state. Thus, current consumption in the standby cycle is reduced.

Figure 16:
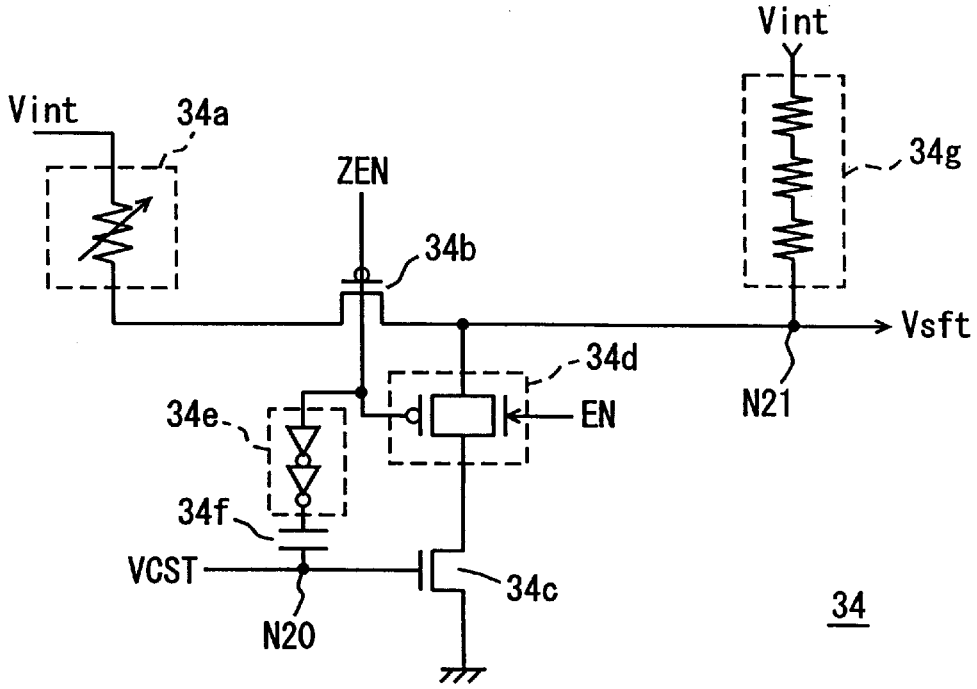
FIG. 16 illustrates the structure of a level shift tuning circuit shown in FIG. 14.

FIG. 16 schematically illustrates the structure of the level shift tuning circuit 34 shown in FIG. 15. Referring to FIG. 16, level shift tuning circuit 34 includes a trimmable resistive circuit 34*a* for lowering the level of internal power supply voltage Vint, a P-channel MOS transistor 34*b* rendered conductive for coupling the resistive circuit 34*a* to a node N21 when operation mode instruction signal ZEN is activated (low), an N-channel MOS transistor 34*c* receiving the constant voltage VCST on a node N20 in its gate to operate as a constant current source, a CMOS transmission gate 34*d* rendered conductive for coupling the node N21 to a drain of MOS transistor 34*c* when operation mode instruction signals ZEN and EN are activated, a buffer circuit 34*e* buffering the operation mode instruction signal ZEN, a coupling capacitor 34*f* coupling an output signal from buffer circuit 34*e* to node N20 by capacitive coupling, and a resistive circuit 34*g* of high resistance coupling the internal power supply voltage Vint to node N21.

Trimmable resistive circuit 34*a* is formed by trimmable resistive elements and has a resistance value thereof trimmed in a tuning step (programming by blowing of a link element, for example). Resistive circuit 34*g* has a high resistance value, and simply serves as pull-up resistance for node N21.

Level shift tuning circuit 34 shown in FIG. 16 is substantially identical in structure to the reference voltage generation circuit shown in FIG. 7.

In the standby state, the operation mode instruction signal ZEN is at a high and the operation mode instruction signal EN is at a low level. Responsively, MOS transistor 34*b* is off and CMOS transmission gate 34*d* is non-conductive. In this state, therefore, node N21 is pulled up to the level of internal power supply voltage Vint by resistive circuit 34*g*, and the shift voltage Vsft is at a level substantially identical to that of internal power supply voltage Vint.

In the active cycle, the operation mode instruction signal ZEN goes logically low and the operation mode instruction signal EN goes logically high. Responsively, MOS transistor 34*b* is turned on, CMOS transmission gate 34*d* is rendered conductive and resistive circuit 34*a* is coupled to node N21. Node N21 is also coupled to MOS transistor 34*c*. A current flows from the trimmable resistive circuit 34*a* to MOS transistor 34*c*, a voltage drop determined by the resistance value of the trimmable resistive circuit 34*a* and the amount of current driven by MOS transistor 34*c* is developed on node N21 and the level of the shift voltage Vsft is lowered below that of internal power supply voltage Vint.

Also when a current abruptly flows to a drain node of MOS transistor 34*c* to raise the drain voltage level, buffer circuit 34*e* and coupling capacitor 34*f* can suppress increase of the constant voltage VCST due to transmission of drain voltage increase in MOS transistor 34*c* to node N20 through a parasitic capacitance by reduction of the voltage level of node N20. Thus, the shift voltage Vsft can be stably produced and stabilized at quick timing after transition to the active cycle.

Figure 17:
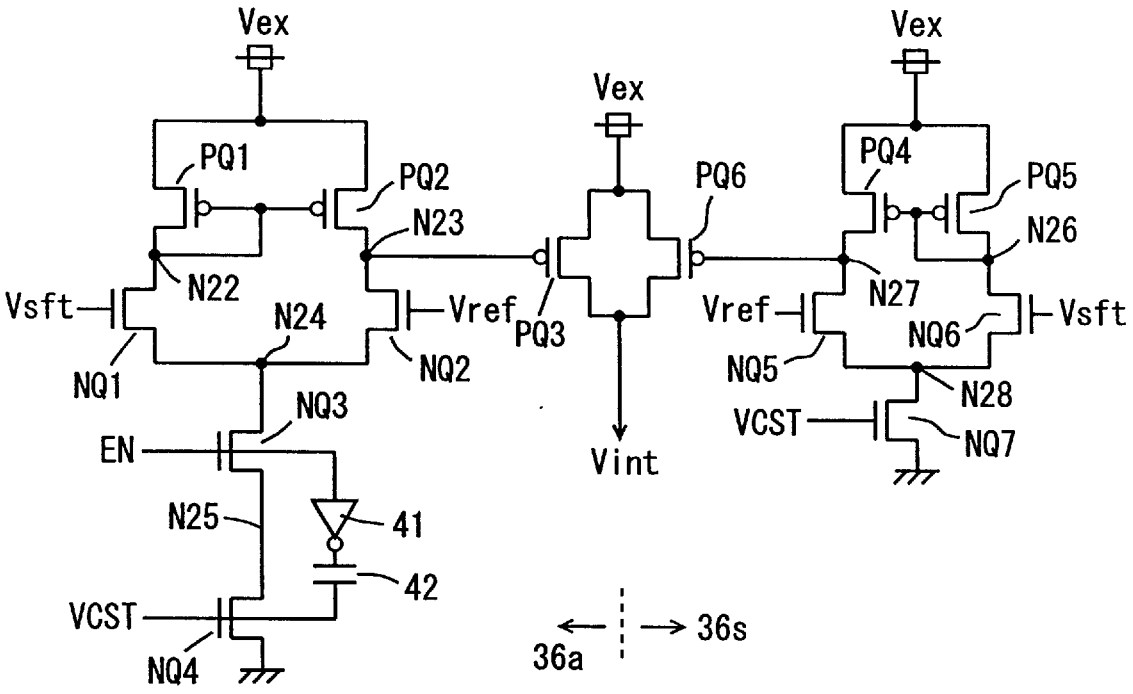
FIG. 17 illustrates the structure of an internal voltage down converter shown in FIG. 14.

FIG. 17 illustrates the structure of the internal voltage down converter 36 shown in FIG. 15. Referring to FIG. 17, active VDC 36*a* includes a P-channel MOS transistor PQ1 connected between an external power supply node and a node N22 with its gate connected to node N22, a P-channel MOS transistor PQ2 connected between external power supply node and a node N23 with its gate connected to node N22, an N-channel MOS transistor NQ 1 connected between node N22 and a node N24 and receiving the shift voltage Vsft on its gate, an N-channel MOS transistor NQ2 connected between node N23 and a node N24 and receiving the reference voltage Vref on its gate, an N-channel MOS transistor NQ3 connected between node N24 and a node 24 and receiving the operation mode instruction signal EN on its gate, an N-channel MOS transistor NQ4 connected between node N25 and a ground node and receiving the constant voltage VCST on its gate, an inverter 41 receiving the operation mode instruction signal EN, a coupling capacitor 42 transmitting an output signal from inverter 41 to a gate of MOS transistor Q4 by capacitive coupling, and a P-channel MOS transistor PQ3 connected between the external power supply node and an internal power supply node with its gate connected to node N23.

When the operation mode instruction signal EN is at a low level, active VDC 36*a* is inactive. More specifically, MOS transistor NQ3 is turned off and the constant current source transistor NQ4 is disconnected from node N24. In this state, therefore, nodes N22 and N23 are driven to the level of external power supply voltage Vex.

When the operation mode instruction signal EN enters a high-level active state, MOS transistor NQ3 is turned on and a constant current driven by MOS transistor NQ4 flows to node N24. When the shift voltage Vsft is higher than the reference voltage Vref, a larger current flows through MOS transistor NQ1 and a mirror current of the current flowing through MOS transistor NQ1 flows through MOS transistor NQ2, to raise the voltage level of node N23. The conductance of MOS transistor PQ3 is responsively lowered and the amount of the current supplied from the external power supply node to the internal power supply node is reduced. When the shift voltage Vsft is lower than the reference voltage Vref, the amount of current flowing through MOS transistor NQ1 is smaller than that of the current flowing through MOS transistor NQ2, the voltage level of node N23 is lowered, and the conductance of MOS transistor PQ3 is responsively increased to increase the amount of current supplied from the external power supply node to the internal power supply node.

Therefore, active VDC 36*a* adjusts the level of internal power supply voltage Vint such that the shift voltage Vsft is equal in level to the reference voltage Vref. Comparison is performed in the most sensitive region of a comparison stage formed in this differential amplifier by utilizing the shift voltage Vsft, for adjusting the level of internal power supply voltage Vint. In the active cycle, the shift voltage Vsft is lowered below internal power supply voltage Vint by trimmable resistive circuit 34*a* and constant current source transistor 34*c* shown in FIG. 16.

When the operation mode instruction signal EN goes high in transition to the active cycle, the constant voltage VCST is raised due to a gate-to-drain parasitic capacitance of MOS transistor NQ4, the operating current of active VDC 36*a* is increased and a correct output voltage responsive to the difference between the reference voltage Vref and the shift voltage Vsft cannot be produced. However, inverter 41 and coupling capacitor 42 lower the level of the constant voltage VCST, when the operation mode instruction signal EN rises, to suppress such increase by the gate-to-drain parasitic capacitance of MOS transistor NQ4 and hold the operating current of active VDC 36*a* constant. After transition to the active cycle, therefore, the operating current of active VDC 36*a* is stabilized at quick timing, and the level of internal power supply voltage Vint can be adjusted by performing correct comparison for adjusting the gate voltage of the current driving MOS transistor PQ3.

Standby VDC 36*s* includes a P-channel MOS transistor PQ5 coupled between an external power supply node and a node N26 with its gate connected to node N26, a P-channel MOS transistor PQ4 connected between the external power supply node and a node N27 with its gate connected to node N26, an N-channel MOS transistor NQ5 connected between node N27 and a node N28 and receiving the reference voltage Vref on its gate, an N-channel MOS transistor NQ6 connected between node N26 and a node N28 and receiving the shift voltage Vsft on its gate, an N-channel MOS transistor NQ7 connected between node N28 and a ground node and receiving the constant voltage VCST on its gate, and a P-channel MOS transistor PQ6 connected between the external power supply node and an internal power supply node with its gate connected to node N27.

MOS transistor NQ7 serving as a constant current source receives the constant voltage VCST on its gate. The ratio of the gate width to the gate length of MOS transistor Q7 is rendered smaller than that of MOS transistor NQ4, and the operating current of standby VDC 36*s* is reduced. In the standby state, the shift voltage Vsft is equal to internal power supply voltage Vint. In the standby state, further, the gate voltage of MOS transistor PQ3 is at the level of external power supply voltage Vex, and MOS transistor PQ3 is off. Therefore, MOS transistors PQ4 to PQ6 and NQ5 to NQ7 adjust the gate voltage of MOS transistor PQ6 such that the internal power supply voltage Vint is equal in level to the reference voltage Vref in the standby state. Standby VDC 36*s* simply suppresses reduction of internal power supply voltage Vint resulting from a leakage current, and internal power supply voltage Vint is maintained in the standby state at a level (Vint=Vref) higher than that (Vref=Vsft) in the active cycle. Thus, even when the standby state is held over a long period, the internal power supply voltage Vint is prevented from remarkably reducing below the prescribed voltage Vsft even if the internal circuit is operated at quick timing after transition to the active cycle, for stably operating the internal circuit.

Standby VDC 36*s* regularly operates. In the active cycle, however, current consumption in active VDC 36*a* is sufficiently larger than that in standby VDC 36*s* and the sensitivity of active VDC 36*a* is sufficiently higher than that of standby VDC 36*s*. Even when standby VDC 36*s* operates in the active cycle, therefore, the level of internal power supply voltage Vint can be adjusted in accordance with active VDC 36*a* with no influence by standby VDC 36*s*.

Figure 18:
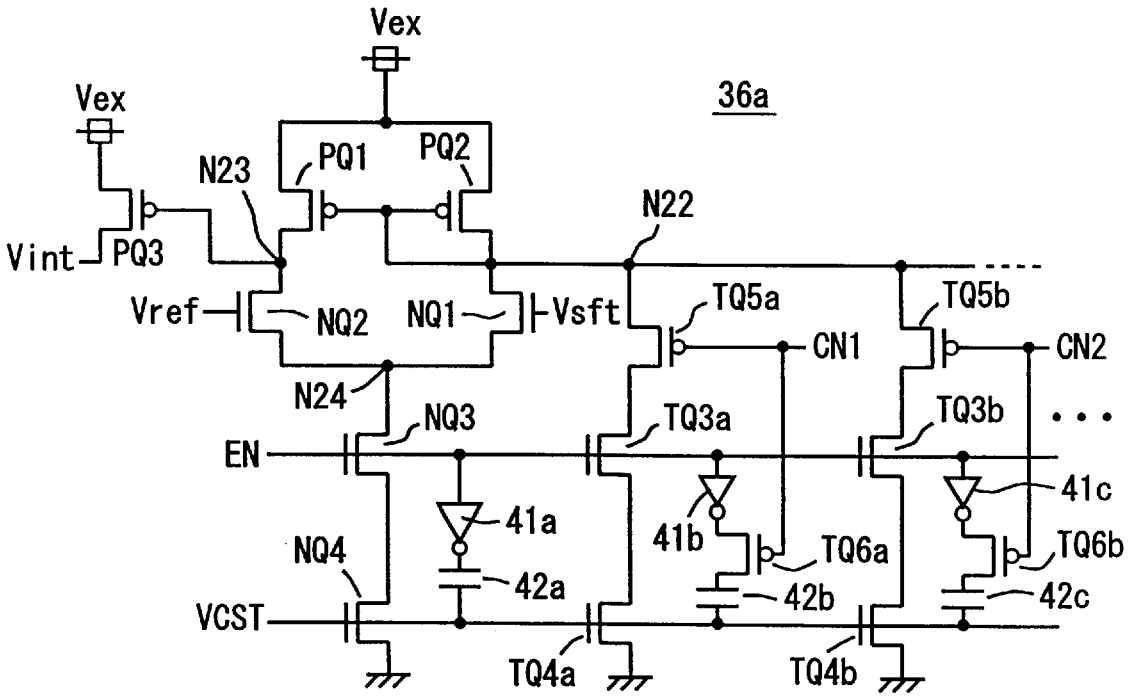
FIG. 18 illustrates a modification of an active VDC shown in FIG. 17.

FIG. 18 illustrates a modification of active VDC 36*a* shown in FIG. 17. In active VDC 36*a* shown in FIG. 18, P-channel MOS transistors TQ5*a*, TQ5*b*, . . . receiving count values CN1, CN2, . . . of a tuning counter respectively are coupled to a node N22, N-channel MOS transistors TQ3*a*, TQ3*b*, . . . receiving an operation mode instruction signal EN are connected in series with MOS transistors TQ5*a*, TQ5*b*, . . . respectively, and N-channel MOS transistors TQ4*a*, TQ4*b*, . . . receiving a constant voltage VCST on their gates are connected in series with MOS transistors TQ3*a*, TQ3*b*, . . .

Active VDC 36*a* further includes inverters 41*b*, 41*c*, . . . provided in correspondence to MOS transistors TQ3*a*, TQ3*b*, . . . respectively for inverting the operation mode instruction signal EN, P-channel MOS transistors TQ6*a*, TQ6*b*, . . . passing output signals from inverters 41*b*, 41*c*, . . . , in accordance with count values CN1, CN2, . . . of the tuning counter, and coupling capacitors 42*b*, 42*c*, . . . , provided in correspondence to MOS transistors TQ4*a*, TQ4*b*, . . . , for transmitting the output signals from inverters 41*b*, 41*c*, . . . supplied through MOS transistors TQ6*a*, TQ6*b*, . . . to a line supplying a constant voltage VCST by capacitive coupling.

In the structure of active VDC 36*a* shown in FIG. 18, the gate width of MOS transistor NQ1 receiving the shift voltage Vsft is selectively increased in accordance with count values CN1, CN2, . . . from the tuning counter. If both count values CN1 and CN2 are set to a low level when MOS transistors NQ1, TQ5*a* and TQ5*b* are identical in size (gate width) to each other, the gate width of MOS transistor NQ1 receiving the shift voltage Vsft is tripled as compared with the structure shown in FIG. 17. When the shift voltage Vsft slightly changes at this time, a current flowing from node N22 to node N24 remarkably changes and the voltage level of node N23 responsively changes at a high speed. Therefore, the shift operation for the shift voltage Vsft in level shift tuning circuit 34 can be further amplified by count values CN1, CN2, ..., for adjusting the internal power supply voltage Vint at a higher speed.

Also in this case, the voltage levels of drains of MOS transistors TQ4*a*, TQ4*b*, . . . change when the operation mode instruction signal EN is activated to possibly increase influence by noise through a parasitic capacitance, and the constant voltage VCST may remarkably change to disable correct power supply voltage control. However, antiphase noise can be transmitted to the constant voltage VCST by utilizing the inverters 41*b*, 41*c* . . . , MOS transistors TQ6*a*, TQ6*b* . . . and coupling capacitors 42*b*, 42*c*, . . . for suppressing the change of the constant voltage VCST resulting from capacitive coupling noise to stabilize the constant voltage VCST at quick timing. Internal power supply voltage Vint can be correctly controlled at a faster timing after activation of operation mode instruction signal EN.

When any of the aforementioned structures according to the first to fifth embodiments is applied to the internal power supply circuit shown in FIGS. 15 to 18, comparing operation is stabilized at a fast timing after transition from the standby cycle to the active cycle, and an internal power supply voltage generation circuit capable of correctly driving the internal power supply voltage Vint to a prescribed level can be implemented.

According to the present invention, as hereinabove described, antiphase capacitive coupling noise is transmitted to a constant voltage node upon switching of an operation mode or a circuit supplying a current to cancel noise is provided, whereby the constant voltage can be prevented from being instable due to capacitive coupling, stabilize operation of an internal circuit. Thus, the internal circuit can be stably operated at a fast timing after mode switching.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A semiconductor integrated circuit device comprising:

a constant voltage generator for generating a constant voltage of a prescribed level;

a reference voltage production circuit coupled to said constant voltage generator and responsive to an operation mode instruction signal for producing a reference voltage in accordance with said constant voltage; and a noise compensation circuit coupled to said reference voltage production circuit for compensating for a change in said constant voltage resulting from an operation of said reference voltage production circuit in response to said operation mode instruction signal.

2. The semiconductor integrated circuit device in accordance with claim 1, wherein said reference voltage production circuit includes:

an insulated gate field effect transistor receiving said constant voltage on a gate thereof, and a current/voltage generation circuit coupled to a first conduction node of said insulated gate field effect transistor and responsive to said operation mode instruction signal for causing a flow of current through said insulated gate field effect transistor producing said reference voltage in accordance with the current flowing through said insulated gate field effect transistor, and said noise compensation circuit includes a voltage application circuit for applying a voltage change opposite in direction to a voltage change of said first conduction node of said insulated gate field effect transistor caused by said current/voltage generation circuit to said gate of said insulated gate field effect transistor in response to said operation mode instruction signal.

3. The semiconductor integrated circuit device in accordance with claim 2, wherein said voltage application circuit includes a coupling capacitive element transmitting said operation mode instruction signal to said gate of said insulated gate field effect transistor through capacitive coupling.

4. The semiconductor integrated circuit device in accordance with claim 3, wherein said current/voltage generation circuit includes a current mirror circuit activated in response to activation of said operation mode instruction signal for supplying a current to said insulated gate field effect transistor, and a current-voltage conversion element for converting a mirror current produced by said current mirror circuit to a voltage to produce said reference voltage, and said voltage application circuit includes a circuit for applying a signal in phase with said operation mode instruction signal to said gate of said insulated gate field effect transistor through said coupling capacitive element.

5. The semiconductor integrated circuit device in accordance with claim 1, wherein said reference voltage production circuit includes:

a plurality of first insulated gate field effect transistors provided in parallel and receiving said constant voltage at respective gates in common, a plurality of second insulated gate field effect transistors each connected between each respective first insulated gate field effect transistor and an internal node and receiving a fixed conduction control signal on a gate thereof, and a reference voltage production circuit activated in activation of said operation mode instruction signal for producing said reference voltage in accordance with a current flowing through said internal node, and said noise compensation circuit includes a voltage application circuit provided in correspondence to the respective first insulated gate field effect transistors for selectively transmitting a signal corresponding to said operation mode instruction signal to the gates of corresponding first insulated gate field effect transistors by capacitive coupling in accordance with the fixed conduction control signals applied to corresponding second insulated gate field effect transistors.

6. The semiconductor integrated circuit device in accordance with claim 5, wherein said voltage application circuit includes a plurality of capacitive elements provided in correspondence to said plurality of first insulated gate field effect transistors respectively and commonly coupled to a constant voltage transmission line, and a plurality of transfer elements provided in correspondence to said plurality of capacitive elements and said plurality of second insulated gate field effect transistors for selectively transmitting said operation mode instruction signal to corresponding capacitive elements in accordance with the conduction control signals supplied to the gates of corresponding second insulated gate field effect transistors, respectively.

7. The semiconductor integrated circuit device in accordance with claim 6, wherein said current/voltage generation circuit includes a circuit for supplying a current to said internal node, when said operation mode instruction signal is activated, to produce said reference voltage in accordance with a mirror current of said current flowing through said internal node, and said voltage application circuit includes means for selectively transmitting said operation mode instruction signal in a same phase to said plurality of capacitive elements through said plurality of transfer elements respectively.

8. The semiconductor integrated circuit device in accordance with claim 1, wherein said reference voltage production circuit includes an insulated gate field effect transistor receiving said constant voltage on a gate thereof, a resistive circuit coupled to a power supply node supplying a power supply voltage of a first logical level, and a connection element for coupling said resistive circuit to said insulated gate field effect transistor when said operation mode instruction signal is activated, said reference voltage is produced from a node coupled with said resistive circuit and said insulated gate field effect transistor, and said noise compensation circuit includes a voltage application circuit for supplying said operation mode instruction signal to said gate of said insulated gate field effect transistor.

9. The semiconductor integrated circuit device in accordance with claim 8, wherein said reference voltage is determined by said power supply voltage and a voltage drop in said resistive circuit, and said voltage application circuit includes a coupling capacitive element transmitting said operation mode instruction signal to said gate of said insulated gate field effect transistor by capacitive coupling.

10. The semiconductor integrated circuit device in accordance with claim 9, wherein a voltage level of a first conduction node of said insulated gate field effect transistor coupled to the node outputting said reference voltage is raised when said operation mode instruction signal is activated, and said voltage application circuit includes means for applying a voltage change antiphase with voltage change of said first conduction node of said insulated gate field effect transistor to said gate of said insulated gate field effect transistor through said coupling capacitive element.

11. The semiconductor integrated circuit device in accordance with claim 9, wherein a first conduction node of said insulated gate field effect transistor is coupled to the node outputting said reference voltage when said operation mode instruction signal is active, and said voltage application circuit includes means for supplying a signal in phase with said operation mode instruction signal to said coupling capacitive element when said operation mode instruction signal changes in a same direction as a voltage on said first conduction node.

12. The semiconductor integrated circuit device in accordance with claim 1, wherein said reference voltage production circuit includes:

an insulated gate field effect transistor receiving said constant voltage at a gate thereof, and a current/voltage generation circuit for causing current flowing through said insulated gate field effect transistor to produce said reference voltage in accordance with said current; and said noise compensation circuit includes a current supply circuit operating complementarily to said current/voltage generation circuit in response to said operation mode instruction signal for causing a flow of current through said insulated gate field effect transistor in a same direction as said current/voltage generation circuit.

13. The semiconductor integrated circuit device in accordance with claim 12, wherein said current/voltage generation circuit supplies the current to said insulated gate field effect transistor when said operation mode instruction signal is activated, and said current supply circuit supplies the current to said insulated gate field effect transistor when said operation mode instruction signal is inactivated.

14. An internal power supply voltage generation circuit comprising:

a differential amplifier stage for comparing an internal voltage corresponding to an internal power supply voltage with a reference voltage and outputting a signal according to result of comparison in operation thereof;

a current drive transistor supplying a current from an external power supply node to an internal power supply node in accordance with the output signal from said differential amplifier stage;

a constant current source transistor receiving a constant voltage on a gate thereof;

an activation control transistor coupling said constant current source transistor to said differential amplifier stage in response to activation of an operation mode instruction signal for activating differential amplification operation of said differential amplifier stage; and a noise compensation circuit for supplying a voltage change, opposite in direction to a voltage change of a node of said constant current source transistor coupled to said differential amplifier stage, to said gate of said constant current source transistor when said operation mode instruction signal is activated.

15. The internal power supply voltage generation circuit in accordance with claim 14, wherein a first conduction node of said constant current source transistor changes in a same direction as transition of said operation mode instruction signal when said operation mode instruction signal is activated, and said noise compensation circuit includes a circuit for inverting the transition of said operation mode instruction signal for transmission to said gate of said constant current source transistor by capacitive coupling.

16. The internal power supply voltage generation circuit in accordance with claim 14, wherein said differential amplifier stage includes:

a first insulated gate field effect transistor receiving a voltage corresponding to said internal power supply voltage at a gate thereof, a second insulated gate field effect transistor receiving said reference voltage at a gate thereof, and at least one program circuit provided in parallel with said first insulated gate field effect transistor, said activation control transistor and said constant current source transistor;

said program circuit includes a program constant current source transistor receiving said constant voltage at a gate thereof, a program activation transistor receiving said operation mode instruction signal at a gate thereof, and a current shift program transistor selectively rendered conductive in accordance with a fixed program voltage for coupling said program constant current source transistor to said first insulated gate field effect transistor; and said noise compensation circuit further includes a program noise compensation circuit provided in correspondence to said program constant current source transistor and said program activation transistor for selectively coupling a signal corresponding to said operation mode instruction signal to a voltage line transmitting said constant voltage by capacitive coupling in accordance with said fixed program voltage.

17. The internal power supply voltage generation circuit in accordance with claim 16, wherein said program noise compensation circuit couples said operation mode instruction signal to the constant voltage transmitting line by capacitive coupling in a same with said noise compensation circuit provided for said constant current source transistor.

18. The internal power supply voltage generation circuit in accordance with claim 14, further comprising a shift circuit for shifting said internal power supply voltage in response to said operation mode instruction signal to produce said internal voltage corresponding to said internal power supply voltage, wherein said shift circuit includes:

a shifting constant current source transistor receiving said constant voltage at a gate thereof, a voltage down circuit for lowering said internal power supply voltage in accordance with a current flowing through said shifting constant current source transistor to produce said internal voltage corresponding to said internal power supply voltage in response to activation of said operation mode instruction signal, and a shifting noise compensation circuit transmitting said operation mode instruction signal to said gate of said shifting constant current source transistor in response to said operation mode instruction signal for causing at said gate of said shifting constant current source transistor a voltage change antiphase to a voltage change of a first conduction node of said shifting constant current source transistor upon activation of said operation mode instruction signal.

19. The internal power supply voltage generation circuit in accordance with claim 18, wherein said shifting noise compensation circuit includes means for transmitting an inverted signal of said operation mode instruction signal to said gate of said shifting constant current source transistor by capacitive coupling when said operation mode instruction signal changes in a same direction as the voltage change of said first conduction node of said shifting constant current source transistor in activation.

20. The internal power supply voltage generation circuit in accordance with claim 18, wherein said shift circuit further includes:

a pull up circuit for pulling up a voltage at an output node producing said internal voltage to a level of said internal power supply voltage, a first transmission gate rendered conductive to couple said voltage down circuit to said output node in response to activation of said operation mode instruction signal, and a second transmission gate rendered conductive to couple said first conduction node of said shifting constant current source transistor to said output node in response to the activation of said operation mode instruction signal.

* * * * *